United States Patent [19]

Valentine

[11] Patent Number: 4,829,977

[45] Date of Patent: May 16, 1989

[54] PORTABLE CAMPFIRE COOKER

[76] Inventor: Edward L. Valentine, 4514 Lillian, Houston, Tex. 77007

[21] Appl. No.: 164,864

[22] Filed: Mar. 7, 1988

[51] Int. Cl.[4] ..... F24C 1/16

[52] U.S. Cl. ..... 126/9 R; 126/25 R; 126/25 A; 126/30; 248/246; 211/186; 211/189; 220/4 F; 220/80

[58] Field of Search ..... 126/9 R, 9 B, 38, 43, 126/25 R, 30, 145, 9 A, 29, 25 A, 25 AA, 152 R; 248/246; 211/186, 189; 220/4 F, 80

[56] References Cited

U.S. PATENT DOCUMENTS

| | | | |
|---|---|---|---|
| 1,212,162 | 1/1917 | Green | 126/9 R |
| 2,839,043 | 6/1958 | LaBorn | 126/30 |
| 2,868,189 | 1/1959 | Watrous | 126/30 |
| 2,960,979 | 11/1960 | Stone | 126/25 R |
| 3,344,780 | 10/1967 | Anderson | 126/30 |
| 3,589,547 | 6/1971 | Hambleton | 220/4 F |
| 3,834,370 | 9/1978 | Nelson | 126/137 |
| 4,083,354 | 4/1978 | Claire et al. | 126/30 |
| 4,126,116 | 11/1978 | McCallum | 126/9 R |
| 4,230,089 | 10/1980 | Barden | 126/30 |
| 4,351,312 | 9/1982 | Ivy | 126/30 |
| 4,363,313 | 12/1982 | Smith | 126/9 R |
| 4,437,450 | 3/1984 | Connelly | 126/30 |
| 4,526,158 | 7/1985 | Lee | 126/9 R |
| 4,726,349 | 2/1988 | Gehrke | 126/9 R |
| 4,794,906 | 1/1989 | Longley, Jr. | 126/9 R |

FOREIGN PATENT DOCUMENTS

| | | | |
|---|---|---|---|
| 674303 | 3/1939 | Fed. Rep. of Germany | 126/9 R |
| 991012 | 9/1951 | France | 126/9 R |
| 23041 | of 1915 | United Kingdom | 126/9 R |
| 241139 | 10/1925 | United Kingdom | 126/9 R |
| 308104 | 3/1929 | United Kingdom | 126/9 R |

*Primary Examiner*—James C. Yeung

*Attorney, Agent, or Firm*—Vaden, Eickenroht, Thompson & Boulware

[57] ABSTRACT

A portable campfire cooker formed of metal walls, posts, grills and other parts, easily assembled and disassembled, providing a rigid and safe fire box. Cylindrical posts lock together interconnecting walls, which walls reciprocably support these posts against inadvertent displacement. Grill supports and pot supports are rotatably mounted on these posts in a secure arrangement. Spit members are similarly mounted onto these posts. Grill, pot and spit members are released by merely lifting from these posts. The walls can be of selected unit lengths to form polygonal shaped fire boxes of symmetrical or non-symmetrical configurations.

10 Claims, 4 Drawing Sheets

FIG. 11
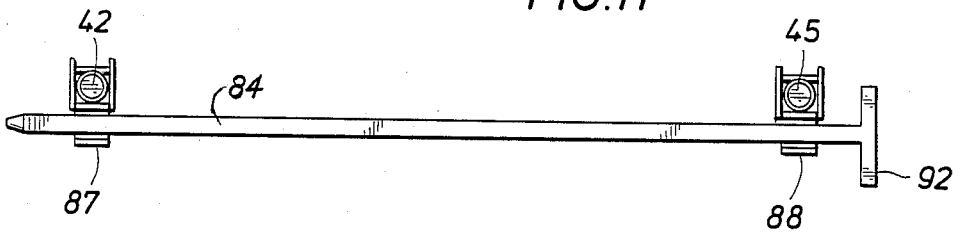
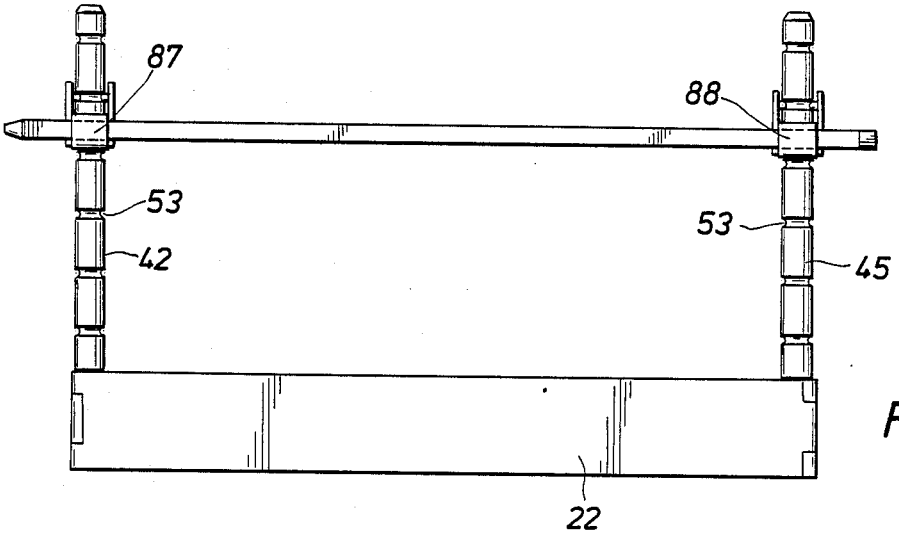
FIG. 12
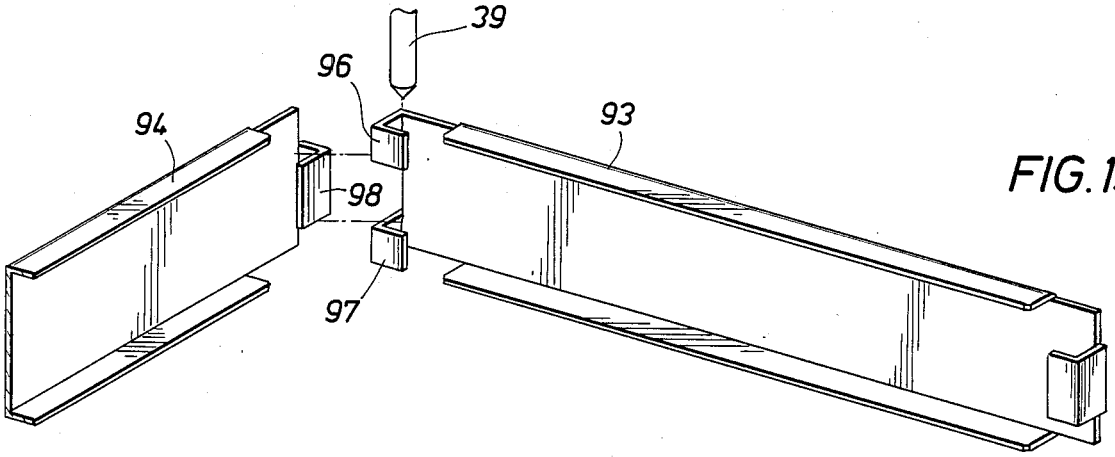
FIG. 13
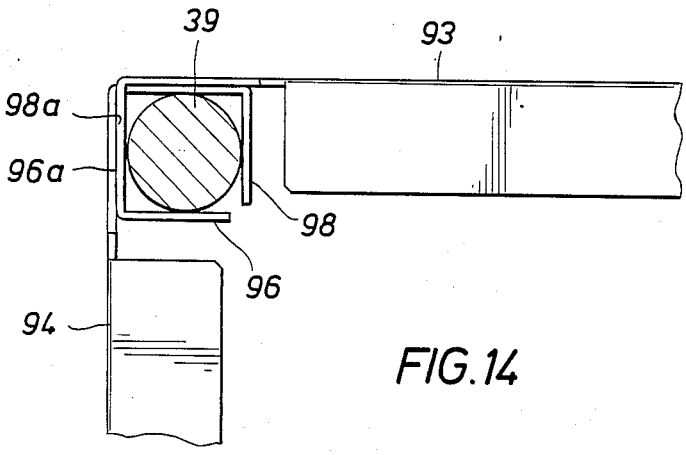
FIG. 14

PORTABLE CAMPFIRE COOKER

BACKGROUND OF THE INVENTION

This invention relates to camping, and it more particularly relates to a protable campfire cooker used in camping.

DESCRIPTION OF THE ART

There are many structures arranged for outdoor cooking using campfires as the heat source. These structures range from the very simple tripod pot holders and spits to complex metal assemblies. Although these assemblies, in many cases, are designed to be made portable, none has proven to be simple in structure and assembly but yet rugged and safe in usage.

Many assemblies use walls of metal panels which are hinged or pinned together for disassembly or folding into the fire box. Additional elements are needed to support pots, pans, and other utensils above the fire box. Stated in another manner, the multitude of parts in these assemblies provide for separate functions either in assembly or in utensil support. Further, these assemblies in use are limited to a certain limited geometric, usually small, rectangular wall configurations. Many assemblies use free standing rods to support pots etc., above the fire box. Naturally, these rods will loosen and fall when the ground is soft. Other assemblies use rods integrally secured to a wall part. This fixed arrangement prevents ready shifting of the rods when movement of the pots etc. above the fire box is required.

Many of our more progressive states (e.g. California and Utah) have restricted open camp fires to firepits so as to eliminate horizontal escape of burning and embers along the ground surface. The state-of-the art fixed sided fireboxes are suitable only for small cooking fires usually to provide food etc. for four people or less. In cooking for larger groups of people, they resort to open ground campfires which activities are in violation of state and Forrestry laws and rules.

The present invention, in camping, is a portable campfire cooker ready assembled from metal walls interconnected by unique posts which support rotably novel support members for pots, grills, and other utensils. These elements cooperate to form the assembled cooker and to provide a rigid and safe cooking structure with rotatable parts.

Also, in the present invention, the fire box can be easily assembled into a size to accommodate cookery for two people or more, e.g., for twenty or more people with the same novel features. All people can enjoy the campfire and cook over the firebox with equal facility and maximum safety to persons and vegetation of the forest areas, and most importantly, the cooking can be done in compliance with state and Forrestry laws and rules.

STATEMENT OF THE INVENTION

In accordance with this invention, there is provided a portable campfire cooker having several metal walls interconnected rigidly together by cylindrical posts, which posts may be inserted at their lower ends into the ground, and their interconnection with the walls supports the posts from lateral and downward unintended displacement. Some posts carry spaced annular grooves which are engaged by unique grill and spit supports. The grill supports have arms supporting horizontal grill members which can be swung about the posts. The supports are released by an upward movement for removal or movement along the rod to another desired position. The spit supports hold a horizontal spit member at a similar selected position in the posts.

In anoher embodiment, the posts carry at their tops a rotatable pot holder by an extending radial arm with terminal hooks. A removable transverse grill can be hooked between opposing side walls. Furthermore, the walls can have selected unit lengths whereby the walls can be arranged into polygons of symmetrical and nonsymmetrical shapes for defining the fire box.

DESCRIPTION OF THE DRAWINGS

The several figures show the preferred embodiment of the invention in portable campfire box cooker, and therein, like elements carry like numerals for convenience of description:

FIGS. 11 and 12 are plan and elevation, in enlargement, of the spit, spit holders, and posts of the cooker shown in FIG. 1;

FIG. 13 is a view like FIG. 3 but with bent ends interconnection between adjacent walls;

FIG. 14 is a plan of the interconnection shown in FIG. 13 but with a post inserted to rigidly secure the walls together;

DESCRIPTION OF PREFERRED EMBODIMENT

Figure 1:
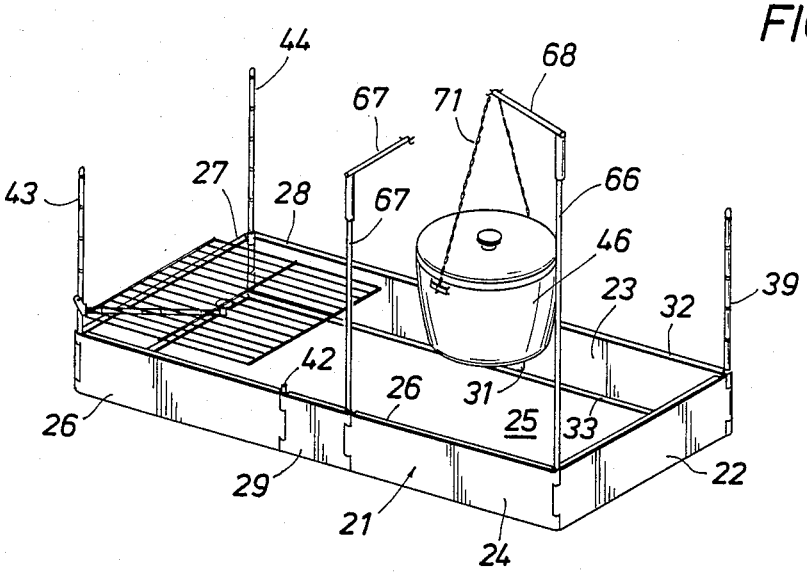
FIG. 1 is a perspective of the cooker formed of several walls into a rectangular fire box, and provided with grill posts and members, and pot posts and members.

Referring now to FIG. 1, there is shown a portable campfire cooker 21 which has a plurality of like metal walls 22–28 and extender metal walls 29 and 31 interconnected uniquely to define the fire box 25. The metal walls have inwardly bent top and bottom edges 32 and 33, respectively. These edges provide stiffness to the walls which can be formed of sheet metal and also to contain flame disrupted embers from sideways expulsions from the fire box. The walls interlock at their adjacent ends by finger-like bends.

Figure 2:
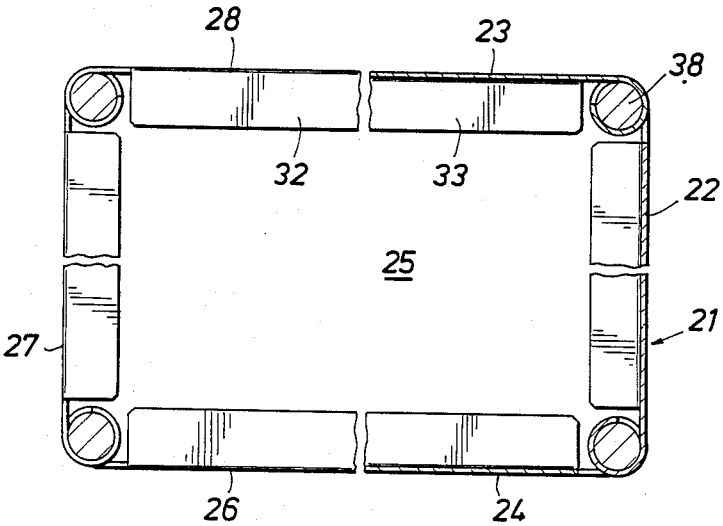
FIG. 2 is a horizontal section taken directly above the walls shown in FIG. 1.
Figure 3:
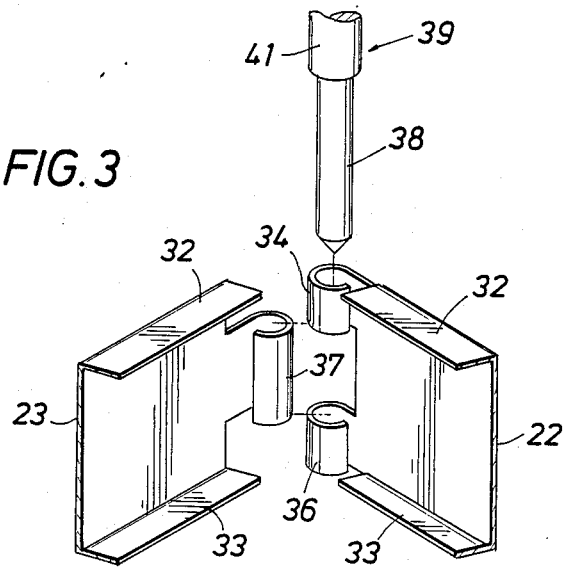
FIG. 3 is a partial view of the rounded ends interconnected between adjacent walls with the post withdrawn from their interlocking ends.

As best seen in FIGS. 2 and 3, the wall 22, at one end, has spaced bends 34 and 36 while the wall 23 has a central bend 37 adapted to the placed between bends 34 and 36. The bends are formed into a semicircular loop (e.g. 270 degrees) and of a diameter to receive the lower end 38 of a grill post 39. The end 38 of the post 39 can have a tapered end to facilitate insertion into the interlocking bends 34, 36, and 37, and to penetrate the ground (if desired) upon which rests the cooker 21. In addition, the grill post 39 has an enlarged shoulder 41 which rests atop edges 32. Importantly, the post 39 by end 38 securely and rigidly interlocks the adjacent walls together while respectively, the interlocked walls secure the post 39 against unintended lateral and downward displacement.

The cooker 21 may have several grill posts, such as posts 42–44 interconnecting walls 29, 26, 27, 28 and 31. (Note, the posts between walls 28, 31, and 23 are hidden by the pot 46.) If desired, the other interconnected walls can be secured by grill posts. However, the cooker 21 can employ pot posts 47 and 48 for interconnecting together the walls 22 and 24, and 24 and 29. The pot posts have the same lower end configuration of the grill posts. Any desired combination of side posts, grill posts, pot posts and walls can be used in the cooker 21.

Figure 4:
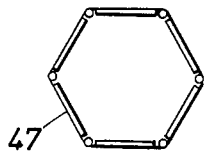
FIGS. 4, 5, and 6 show in plan various illustrative polygonal shapes that define fire boxes enclosed by the wall arrangements of this cooker.
Figure 5:
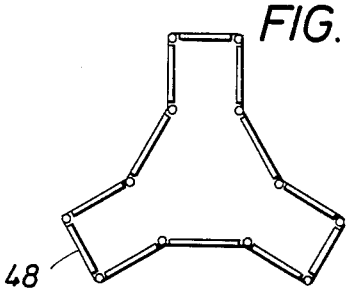
Figure 6:
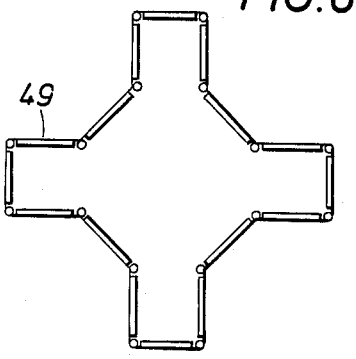

In summary, the ends of each wall have the single bend and dual bends for interconnection as shown in FIG. 3. Thus, adjacent walls can be connected by posts as desired to form any desired shape for the enclosure. Preferably, the like metal walls 22–28 have an extended length compared to the extender walls 29 and 31. If the relationship between the extender walls and like long walls is arranged particularly, the walls can be interlocked into the polygonal shapes 47, 48, and 49 respectively as shown in FIG. 4 (hexagon), FIG. 5 (triangular polygon with three wall sides and one end wall), FIG. 6 (cross with three wall sides and one end wall) and rectangular as shown in FIG. 1. These shapes define the fire box 25 in symmetrical or non-symmetrical configurations. If the unit length of the walls are selected in multiples of the extender walls and other long walls, then these walls can be arranged into any desired shapes enclosing the fire box 25. For example, the extender wall 29 can be 6 inches long, and the long walls 22–24 and 26–29 can be selected from lengths of 16, 22, 28 or 34 inches.

Figure 7:
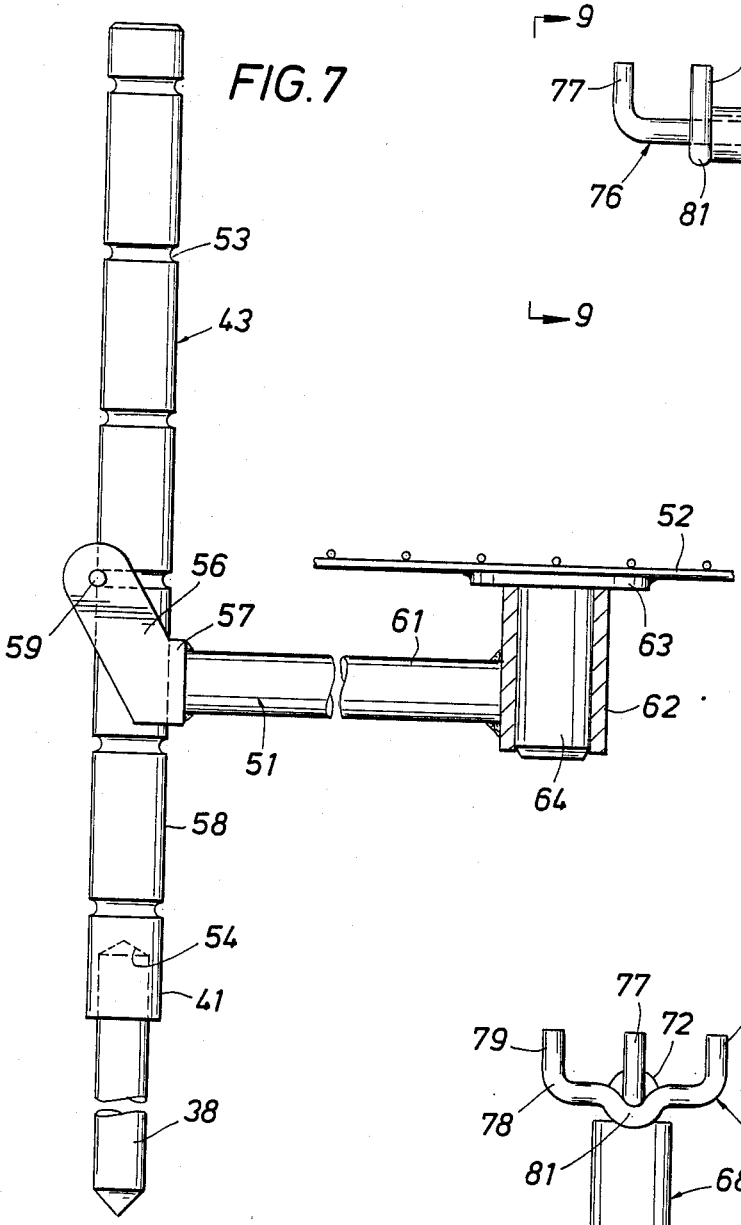
FIG. 7 is an enlarged elevation of the grill posts, and grill support carrying the grill shown in FIG. 1.

Referring to FIG. 7, there is shown in example one grill post 43 carrying metal grill support 51. On grill support 51 is rotatably mounted a grill member 52. For this mounting, the grill post 43 carries one or more annular grooves 53 spaced along its upper length. Preferably, the post 43 is steel and the grooves 53 are semicircular in configuration to avoid transverse stress zones which can lead to breaking and bending of the parts. If desired, the lower pointed end 38 can be made as a cylindrical piece and driven into a socket 54 formed coaxially within the shoulder 41 on the grill post 43. The end 38 is of a length to traverse the bends on the walls and to penetrate the supporting ground.

The grill support 51 is constructed of parallel sides 56 which embrace the side of the grill post 43. These sides are secured integrally by an end side 57, which end side forms an abutment against the side 58 of the post 43. The sides 56 extend diagonally across the post 43 to a transverse pin 59 secured integrally within suitable openings in these sides. Also, a tubular arm 61 is secured at one end to the end side 57 and at its other end carries integrally and vertically upright tubular member 62. The grill member 52, of suitable wire construction, mounts horizontally circular pole 63 that carries a downwardly projecting pin 64 rotatably received within the member 62. With this arrangement, the grill support 51 can be rotated about the grill post 43 so as to swing the grill member 52 to and from above the fire box 25. In the rotation, the pin 59 slides securely within the groove 53, and the end side 56 rests upon the side 58 of post 43, under weight of the grill member 52 and arm 61. The grill member 52 can be rotated with tubular member 62, or pulled upwardly and released from the grill support 51.

The grill support 51 can be raised so as to release laterally the pins 54 from groove 53. Then, the grill support 51 can be slipped from the post 43 or moved to another groove 53 for better cooking position relative to the fire box 25.

The posts to support the pot 46 may be the grill posts or a like member without grooves such as the pot posts 66 and 67. These pot posts carry topmost pot holders 68 and 69, respectively. The pot 46 is hooked to the pot holder 68 by chain 71 at a convenient height above fire box 25.

Figure 8:
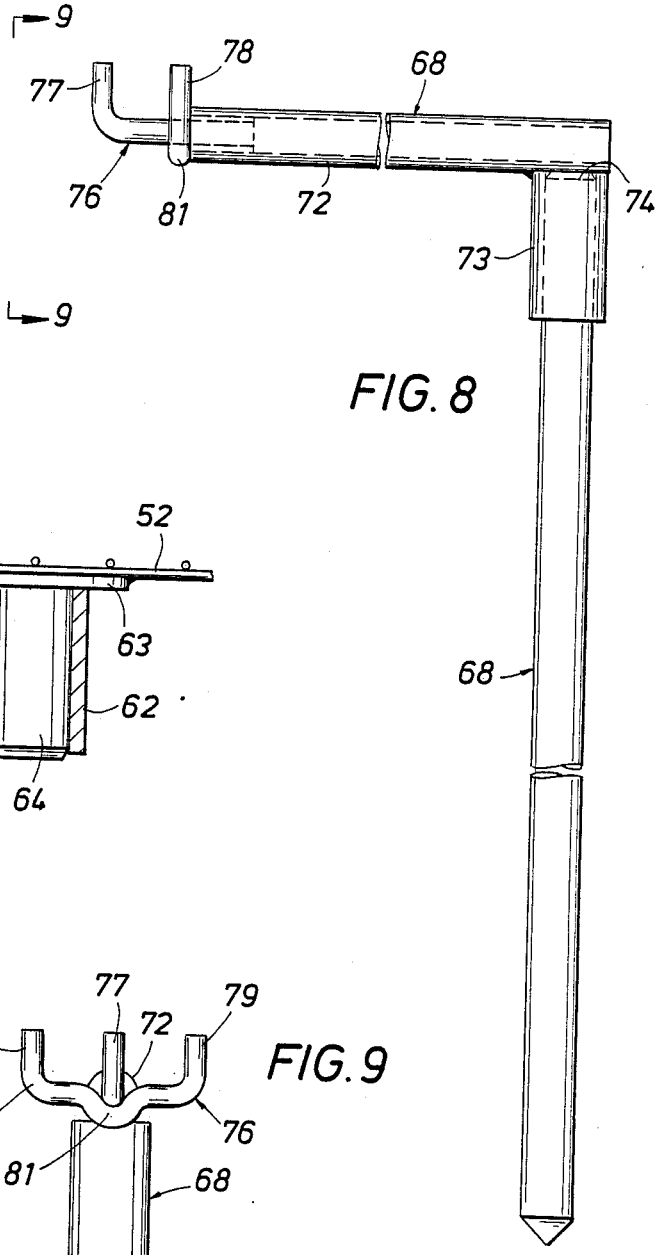
FIG. 8 is an enlarged elevation of the pot post, and pot support with hooks for engaging the pot shown in FIG. 1.
Figure 9:
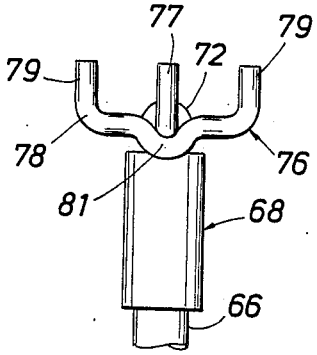
FIG. 9 is an end view taken along line 9—9 of the grill support shown in FIG. 8.

Referring to FIGS. 8 and 9, the pot holder 68 has a radial tubular arm 72 with at one end carrying an upright socket 73 received rotatably over the top end 74 of the pot post 66. The arm 72 at its other end carries hook arrangement 76. This arrangement 76 is formed of a bent rod 77 secured (as by welding) into the end of arm 72. Another rod 78 with bent ends 79 is secured (as by welding) at a u-bend 81 to the rod 77 and end of the arm 72. The chain 71 can be placed about any one of the hooks formed by the arrangement 76 and allows height adjustment of the pot 46 relative to the fire box. The pot holder 68 allows rotation of the pot holder 68 atop the pot post 66 for convenient positioning relative to the fire box 25. If desired, the pot holder 68 removal is by pulling upwardly to remove the socket 73 from atop the post 66. It will be apparent that the pot holder 68 can be readily mounted atop the grill posts, if desired, during the cooking of food.

Figure 10:
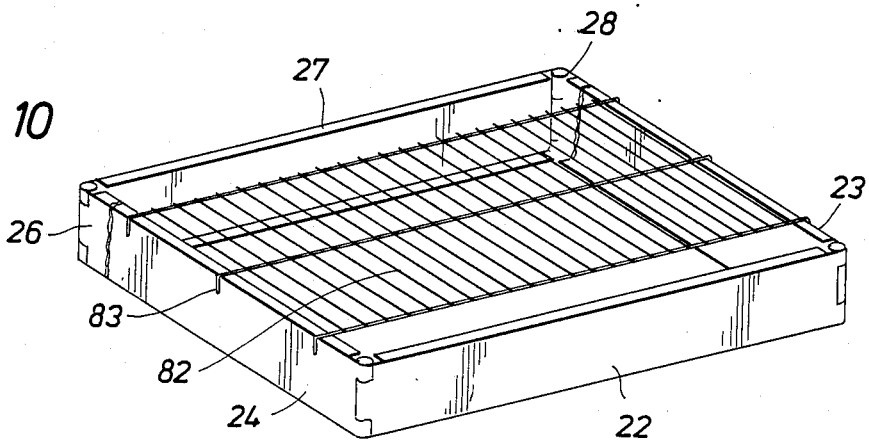
FIG. 10 is a perspective illustrating a horizontal grill hooked between opposite walls of the cooker shown in FIG. 1.

The cooker 21, as shown in FIG. 10 can be provided with a horizontal grill 82, of conventional construction, with hook ends 83 that are received over the top edges of opposing walls 23 and 24. The grill 82 can be used for certain cooking, such as broiling steaks and the like.

The cooker 21 can be provided with a spit arrangement as is shown in FIGS. 11 and 12. This arrangement utilizes grill posts 42 and 45 carrying a plurality of grooves 53 spaced along their length. Spit support 84 is constructed like the grill support 51 except the arm 61 is replaced by upstanding hooks 87 and 88, respectively. A spit member 91, preferably of square cross section rests within these hooks and terminates in a tee handle 92. As a result, the spit support can be rotated or moved vertically along the grill posts as desired. Also, the spit member 91 can be turned within hooks 87 and 88 by the handle 92 or lifted clear of the spit support when desired during cooking operations. If desired, the hooks 88 may engage the square spit member to prevent unintentional rotation. But lifting spit member 91 clear of hook 88, the member 91 can be rotated by handle 92.

In FIGS. 13 and 14 are shown another embodiment of the wall used in the cooker 21. The walls 93 and 94 are like the previously described walls (e.g. 22, 23) but have a rectangular bend 96 and 97 on the wall 93 and bend 98 on the wall 94. The grill post 39 is received slideably but snugly with a spring-type embrace within these bends. This spring type securing of the grill post at the interconnection of the walls provide increased rigidity for the cooker 21. Also, the bends nest to support loads more securely. Furthermore, the assembled interconnection, as seen in FIG. 14, provides a rigid lock in the 90 degree arrangement of the walls since the rectangular sides of the bends can engage each other. The bends 96 and 97 rest with their exterior side faces 96*a* and 97*a* pressed against the interior side faces 98*a* of the wall 94. With the post 39 within these bounds, the walls 93 and 94 one locked into a rigid right angular configuration even of the post is not driven into the ground. Thus, the cooker 21 can be rigidly configured into rectangular shapes (but not straight lines) without relying upon fixing the posts into the ground.

Figure 16:
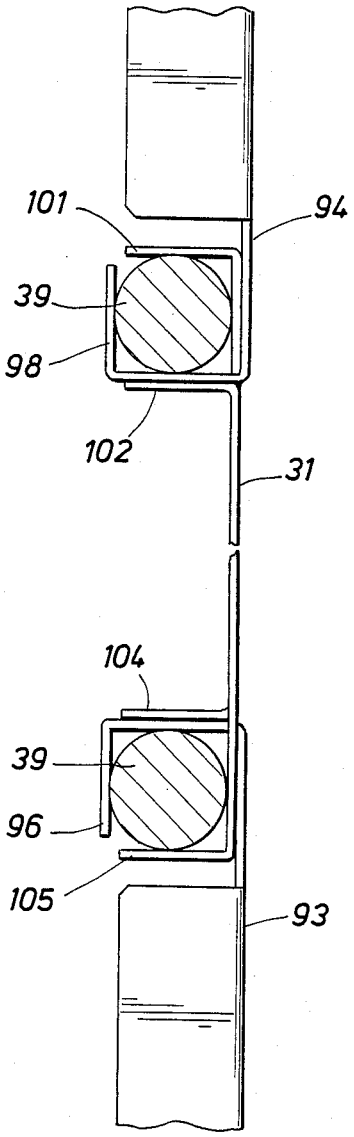
FIG. 16 is a plane view of the extender wall secured between adjacent walls by posts.
Figure 15:
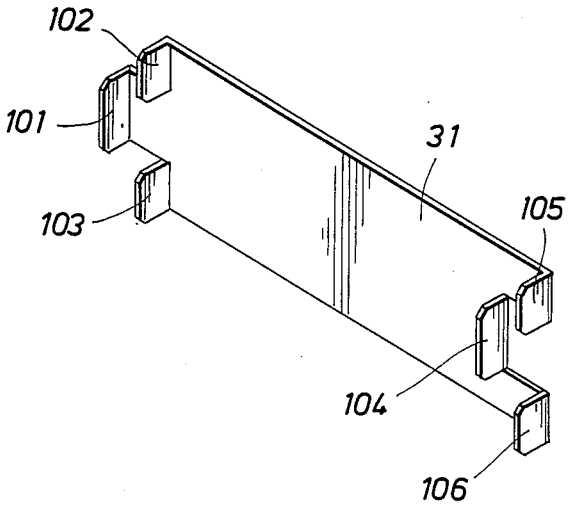
FIG. 15 is an elevation of one extender wall for extending lengthwise of the cooker.

However, the use of the extender walls 29 and 31 require a slight modification of their bends. As seen in FIGS. 15 and 16, these extender walls carry only right angled bends 101, 102, 103 at one end and bends 104, 105 and 106 at the other end. The bends 101, 102 and 103 will interfit with bends 96 and 97 of the wall 93 while bend 101, 102 and 103 interfit with the bend 98 of the wall 94, and the walls 93, 31 and 94 are secured in straight alignment by the posts 39, etc.

From the foregoing, it will be apparent that there has been described a unique portable campfire cooker well arranged to provide safe and convenient campfire cooking. Certain changes and alterations can be made in this cooker without departing from the spirit of this invention. These changes are contemplated by and are within the scope of the appended claims which define this invention. Additionally, the present description is intended to be taken as an illustration of this invention.

What is claimed is:

1. A portable campfire cooker comprising a plurality of pieces in ready disassembly for transportation but adapted for convenient assembly into a rigid and safe fire box for supporting grills, pots, pans, dutch ovens and the like, comprising:

a plurality of sheet metal walls forming an enclosed fire box resting upon the ground surface having lipped top and bottom edges and interlocking ends having one or more return bends adapted to interfit with a mating adjacent wall and secured together by a vertical cylindrical post which post is driven into the ground thereby securing rigidly said walls together and in fixed positions to the ground;

at least one of said vertical cylindrical posts having longitudinally annular grooves spaced along the length of said post;

a grill support rotatably and releaseably mounted by a support member on said post having annular grooves, said support having a radial arm extending sideways from said post with a terminal end mounting a horizontal grill member, said grill member of a size to be swung to various positions above said walls forming said fire box and sideways outside said fire box;

said support member secured at the end of said radial arm remote from said grill member, said support member having parallel sides embracing the sides of said post and said sides carrying a transverse pin adapted to engage one of said annular grooves, said parallel sides adjacent said radial arm having an upright abutment to engage the sides of said post, and said parallel sides extending diagonally from said abutment across said post to said transverse pin whereby said support member can rotate in vertical secured relationship about said posts with said pin engaging said groove but raising said radial arm releases said pin from said groove whereby said support member can be moved vertically relatively to said post for convenient positioning or removal; and each said post carrying said support member having a pointed lower end for ready insertion into the ground and an enlarged shoulder portion spaced from said lower end and said shoulder abutting the upper edges of said walls secured together by said post whereby said post is secured against the weight of said grill member from being undesireably pushed into the ground.

2. The cooker of claim 1 wherein at least one of said cylindrical posts carries at its upper end a rotatable pot holder, said post having a pointed lower end for ready insertion into the ground and an enlarged shoulder portion spaced from said lower end and said shoulder abutting the upper edges of said walls secured together by said post whereby said post is secured against the weight of said pot holder from being undesireably pushed into the ground, and said pot holder having a radial arm extending sideways from said post with a hooked terminal end arranged for suspending a pot or like utensils, and said pot holder having an upright socket terminal on said arm for reasonably mounting atop said pots whereby said pot holder can be rotated about said post to position the utensils relative to said fire box.

3. The cooker of claim 2 wherein said hooked terminal is carried at one end of a tubular member forming said radial arm, and said hooked terminal comprises an upright bent rod secured within said tubular member and a second rod with upright bend ends is secured transversely to said tubular member and said bent rod.

4. The cooker of claim 2 whereas said post is selected from cylindrical posts carrying annular grooves.

5. The cooker of claim 1 wherein said support member has a tubular member forming said radial arm, said parallel sides connected by an end side forming said upright abutment with said tubular member secured to said end side, and said terminal end formed of a second tubular member secured upright at one end of said tubular member and receiving rotatably a downwardly extending pin carried by said horizontal grill member whereby said grill member can be rotated in the horizontal.

6. The cooker of claim 1 wherein a removable grill is mounted transversely between opposite walls by a plurality of downwardly extending hooks carried at the ends of rods supporting said grill.

7. The cooker of claim 1 wherein said walls carry circular shaped return bends to snugly receive said cylindrical posts whereby said walls can be arranged into a desired fire box shape before said posts are inserted into the ground.

8. The cooker of claim 1 wherein said walls carry return bends formed into a three sided right angular form whereby said walls are secured by insertion of said posts into the ground through said bends between mounting walls, while walls in an angular configuration are restrained from movement by said bends.

9. The cooker of claim 1 provided with a spit wherein cylindrical posts secure said walls on opposite sides of said fire box and said cylindrical posts having longitudinally spaced annular grooves spaced along said posts, and said posts having a pointed lower end for ready insertion into the ground and an enlarged shoulder spaced from said lower end and said shoulder abutting the upper edges of said walls secured together by said posts whereby said posts are secured against weight of said spit from being undesireably pushed in to the ground, said spit formed of a transverse elongated spit member secured releaseably to said posts by spit supports, and each said spit supports having parallel sides embracing the sides of said post and sides carrying a transverse pin adapted to engage one of said annular grooves, said sides adjacent to said spit member having an upright abutment to engage the sides of said posts and upright bent hooks to secure said spit member, and said parallel sides extending diagonally from said abutment across said post to said transverse pin whereby said spit supports can be rotated about said posts with said pin engaged in said grooves but raising said spit member by its hooks releases said pin from said groove whereby said spit support can be moved vertically relative to said post for convenient positioning and removal from said cooker.

10. A portable campfire cooker comprising a plurality of pieces for transportation but adapted for convenient assembly into a rigid and safe firebox for supporting grills, pots, pans, dutch ovens and the like comprising:

a plurality of sheet metal walls forming an enclosed firebox resting upon the ground surface having lipped top and bottom edges and interlocking ends having one or more return bends adapted to interfit with a mating adjacent wall and secured together by a vertical cylindrical post which post is driven into the ground thereby securing rigidly said walls together and in fixed position to the ground;

a removable grill mounted transversely between opposite walls by a plurality of downwardly extending hooks carried at the ends of rods supporting said grill;

said walls carrying return bends each bend formed into a three sided right angular form adapted to embrace said post whereby said walls are secured by insertion of said posts into the ground through said return bends on interfitted mating walls which walls are secured in an angular configuration restrained from movement by said bends; and said bends of one mating wall abutting face-to-face with said bends of the other mating wall whereby said mating walls rigidly interlock selectively into right angular configuration with placement of said locking pin therebetween.

* * * * *